US005992522A

United States Patent [19]

Boyd et al.

[11] Patent Number: 5,992,522

[45] **Date of Patent: *Nov. 30, 1999**

[54] PROCESS AND SEAL FOR MINIMIZING INTERZONAL MIGRATION IN BOREHOLES

[75] Inventors: John Wesley Boyd; John Balslev Jorgensen; Victor Freeman Maxwell, all of Calgary, Canada

[73] Assignee: Steelhead Reclamation Ltd., Calgary, Canada

[ * ] Notice: This patent is subject to a terminal disclaimer.

[21] Appl. No.: 08/929,256

[22] Filed: Sep. 15, 1997

Related U.S. Application Data

[60] Provisional application No. 60/055,493, Aug. 14, 1997.

[51] Int. Cl.[6] ..... E21B 33/138

[52] U.S. Cl. ..... 166/292; 166/285; 166/294

[58] Field of Search ..... 166/292, 290, 166/291, 294, 277, 298, 192, 285, 289

[56] References Cited

U.S. PATENT DOCUMENTS

| | | | |
|---|---|---|---|
| 1,491,427 | 4/1924 | Smit . | |
| 2,164,266 | 6/1939 | Larmentrout et al. . | |
| 3,814,187 | 6/1974 | Holman | 166/281 |
| 3,901,316 | 8/1975 | Knapp . | |
| 3,995,694 | 12/1976 | Freiburger . | |
| 4,173,999 | 11/1979 | Messenger . | |
| 4,275,788 | 6/1981 | Sweatman | 166/292 |
| 4,339,000 | 7/1982 | Cronmiller . | |
| 4,463,808 | 8/1984 | Mason et al. | 166/292 |
| 4,671,357 | 6/1987 | Binder, Jr. | 166/291 |
| 4,736,796 | 4/1988 | Arnall et al. . | |
| 4,842,063 | 6/1989 | Coetzee et al. . | |
| 4,898,242 | 2/1990 | Jennings, Jr. et al. . | |
| 4,909,323 | 3/1990 | Hastings . | |
| 4,966,237 | 10/1990 | Swanson et al. . | |
| 5,004,298 | 4/1991 | Boulanger et al. . | |
| 5,095,992 | 3/1992 | Jones | 166/380 |
| 5,105,879 | 4/1992 | Ross . | |
| 5,159,980 | 11/1992 | Onan et al. | 166/294 |
| 5,199,489 | 4/1993 | Johnson et al. . | |
| 5,215,147 | 6/1993 | Grego et al. . | |
| 5,293,939 | 3/1994 | Surles et al. . | |
| 5,327,969 | 7/1994 | Sabins et al. | 166/250.14 |
| 5,343,952 | 9/1994 | Cowan et al. | 166/295 |
| 5,389,146 | 2/1995 | Liao | 106/811 |
| 5,657,822 | 8/1997 | James et al. | 166/292 |
| 5,667,010 | 9/1997 | Boyd et al. | 166/292 |

FOREIGN PATENT DOCUMENTS

WO 95/09964 4/1995 WIPO .

OTHER PUBLICATIONS

Well Abandonment Guide, Aug., 1994, p. 1–37, Guide G–20, Energy Resources Conservation Board, Calgary, Alberta.

Edson, Jim, "Gas Migration in Heavy Oil", 1989.

Abandonment Plugs, Feb. 1, 1981, Amoco Canada Petroleum Company Ltd.

*Primary Examiner*—William Neuder
*Assistant Examiner*—Chi H. Kang
*Attorney, Agent, or Firm*—Bennett Jones

[57] ABSTRACT

A process and a material for use in sealing casing lining in a borehole is taught. The process includes the placement of a bitumen sealant material in a position between the casing tube and the wall of the borehole to be maintained in this annulus by means of a retaining devise such as an external casing packer or with the placement of a retainer made of cement grout and situated at the lower end of the casing tube. The bitumen sealant material prevents the passage of fluids vertically through the borehole. The sealant material remains viscous over time and can flow to fill voids which may occur in the rock formations adjacent to the borehole, or in the steel casing of the casing tube. To improve the sealing capabilities of the bitumen material a measured amount of fine grain weight material can be added to the bitumen to increase the density of the sealant material and thereby increase the hydrostatic pressure that the column of bitumen sealant will exert on the bottom and the walls of the borehole.

49 Claims, 10 Drawing Sheets

PROCESS AND SEAL FOR MINIMIZING INTERZONAL MIGRATION IN BOREHOLES

This application claims priority from U.S. provisional patent application Ser. No. 60/055,493, filed Aug. 14, 1997.

FIELD OF THE INVENTION

This invention is directed to a seal and a process for minimizing interzonal fluid migration in boreholes.

BACKGROUND OF THE INVENTION

When petroleum well bores are drilled to the desired depth for production, the well operator determines whether the well bore should be placed into production or abandoned. A bore hole cuts through the various rock layers in the formation through which it is drilled and provides a route between the numerous porous zones of the formation. The bore hole allows fluids to migrate either upwardly or downwardly in between zones. Such interzonal migration must be controlled.

When it is determined that the well bore should be placed into production, a casing is run into the well. The casing is a length of tubing usually formed of steel. To prevent migration of fluids through the annulus between the casing and the well bore wall, a cement slurry is often pumped into the annulus during well completion. The cement is placed in sufficient volume to displace the drilling fluid in the annulus and is intended to prevent interzonal migration of fluid outside of the casing. However, fluid migration outside of the casing sometimes occurs through voids formed during set up of the cement or due to cement decomposition. Because the cement, when set, is solid, any voids formed in the cement during set up are permanent.

In some drilled bore holes, it is determined that the hole is not suitable for production. Such a bore hole is abandoned without running casing. Cement is also used in open boreholes to plug and abandon the well. Voids may also form during the set up of the cement in an abandonment plug.

Problematic interzonal migration occurs through voids in the cement seals used for completion and abandonment of boreholes.

SUMMARY OF THE INVENTION

A seal and a process have been invented for minimizing interzonal migration of fluids in a borehole.

In accordance with a broad aspect of the present invention, there is provided a process for sealing a borehole having a bottom, the process comprising placing an amount of a bituminous material into the borehole to extend up from the bottom of the borehole, the bituminous material being selected to remain viscous over time in borehole conditions retaining its ability to flow.

In accordance with another broad aspect of the present invention, there is provided a process for sealing a well, the well having a borehole defined by a bottom and side walls and being lined with a casing, the process comprising placing an amount of a viscous material into the casing, to fill a length of the borehole above the bottom of the borehole, the viscous material being selected to remain viscous over time in borehole conditions, to retain its ability to flow.

In accordance with a further broad aspect of the present invention, there is provided a casing annulus seal comprising an amount of viscous material disposed in the casing annulus, the material being selected to remain viscous over time in borehole conditions, the amount of viscous material in the annulus forming a vertical column sufficient to effect a seal against the pressure of fluids attempting to migrate into the annulus, and a means for retaining the viscous material in the annulus.

In accordance with a further broad aspect of the present invention, there is provided a casing annulus seal comprising: an amount of bituminous material disposed in the casing annulus and a means for retaining the bituminous material in the annulus.

In accordance with a further broad aspect of the present invention, there is provided a well comprising a borehole having a wall and lined along a portion of its length with a casing, an amount of viscous material disposed in the casing annulus, the material being selected to remain viscous over time in borehole conditions, and a means for retaining the viscous material in the annulus.

In accordance with another broad aspect of the present invention, there is provided a process for completing a cased well, the well having a casing extending therein and a casing annulus surrounding the casing, the process comprising: retaining an amount of a viscous material in the casing annulus, the viscous material being selected to remain viscous over time in borehole conditions, to retain its ability to flow.

In accordance with a further broad aspect of the present invention, there is provided a process for completing a cased well, the well having a casing extending therein and a casing annulus surrounding the casing, the process comprising:

retaining an amount of a bituminous material in the casing annulus.

DESCRIPTION OF THE INVENTION

The seal and process of the present invention are useful in cased wells to reduce interzonal migration of fluids between the borehole wall and the casing in the area termed herein as the casing annulus. The seal and process of the present invention are also useful in cased or uncased wells during well or borehole abandonment.

The seal includes a viscous material which is placed where a seal against the migration of fluids is desired for example in the casing annulus or across the borehole. A viscous material which is useful in the present invention is a material which will remain viscous over time in borehole conditions thereby retaining its ability to flow. The viscous material must be of sufficient viscosity to prevent the leakage and loss of the material into fissures and porous materials (i.e. sandstone). In one embodiment, the viscous material contains solid material and preferably fine grain solid matter such as for example, clay fines and/or sand. In a preferred embodiment, the solid material is present in a gradation of sizes to enhance the plugging and sealing characteristics of the viscous material. The viscous material must also have a density greater than water so that it will not be displaced by water which may be present in the borehole. It has been found that a bituminous material, such as asphalt, is useful for use as the sealing material.

The seal includes a retaining means to maintain the placement of the viscous material in the borehole. Suitable retaining means depend on the desired position of the seal. Where the seal is in the annulus of a cased well, the retaining means can be, for example, a mechanical means such as an external packer, or other means such as a cement platform or a combination thereof. Where the seal is in an open bore hole, the retaining means can be the bottom of the bore hole.

Since the retaining means acts to prevent the seal from moving out of its sealing position, the permanency of the seal can be controlled by the selection of the retaining means. For example, a temporary mechanical means can be used to temporarily retain the viscous material of the plug, while viscous material placed on the bottom of the borehole will be retained indefinitely, thereby forming a substantially permanent seal. The materials used to form the retaining means are preferably selected with consideration as to the borehole conditions. For example, where a formation produces hydrogen sulphide, the retaining means is preferably formed of sulphate resistant materials, such as sulphate resistant cement.

The sealing properties are provided by the hydrostatic pressure of the viscous material as determined, for example, by the height and density of the column of viscous material used. The hydrostatic pressure forces the material into fissures of the formation and into close contact with the structures in the borehole and acts against the pressure of fluids attempting to migrate from the productive zone. The hydrostatic pressure can be increased by increasing the height of the column of viscous material. In one embodiment, the viscous material extends from the retaining means to the surface opening of the borehole. In instances where bituminous material is only placed in the lower portion of the borehole, additional hydrostatic pressure can be provided by the presence, above the viscous material, of a liquid having a lower density than the viscous material. In one embodiment, the viscous material is a bituminous material and the liquid is water.

Alternately or in addition, the hydrostatic pressure of the viscous material can be increased by the addition of weighting materials thereto. For example, where the viscous material is asphalt, weighting materials such as crushed and/or ground barite and/or calcium carbonate can be added thereto to increase the density of the viscous column.

The seal is preferably placed in the portion of the well which passes through a layer of impermeable rock to prevent the passage of fluids between the productive zone and upper layers. The process for placement of the seal can include a preliminary examination of data related to the borehole to locate the position of the impermeable rock layer. Further, in the preferred embodiment the borehole and well data is examined to determine additional information, for example: the pressure of the fluids in the productive zone (this is useful information in the determination of the hydrostatic pressure which is required to effect a seal); and the most likely source of fluids that may migrate up the borehole (useful in determining if the fluids are hazardous or corrosive).

The viscous material can be placed in the well by any suitable means. For example, where the viscous material is bituminous material, it can be placed in the well by heating it to reduce its viscosity temporarily. This enables it to be pumped down the well. It can, alternately, be dumped at ambient surface temperature down the well. In another method, the bituminous material is introduced to the well as an emulsion. Once introduced the emulsion can be left to break on its own or can be broken by use of suitable breakers such as, for example, salt brine, acids, caustic soda or by passing an electric current therethrough. In yet another method, the material is cooled to a solid or near-solid state and processed to form pellets. The pellets are dumped down the well. At well temperatures, the pellets liquefy to a viscous state and flow to fill the space in the well into which they are introduced.

The seal is used in any position in a well where it is desired to seal off a passage of fluids. The fluids can be oil, gas, water or any other fluid which is leaking through the well bore. In one embodiment, the seal can be in the annulus of a cased well to complete the well and prevent migration of fluids outside of the casing in producing wells. In another embodiment, the seal is used as a plug during well abandonment to block migration of fluids along the well.

When the seal is used as a well bore abandonment plug, the plug can be used in cased wells or uncased wells. The plug can be placed to extend up from the bottom of the well. When it is placed in this way, the bottom of the well will retain the plug in position. Alternately, the plug can be positioned to extend upward from any position in the well by use of another retaining means such as a cement platform which is already present in the well or which is placed in the well to assist in plug placement.

To form the plug, the viscous material is introduced to the well to extend up either from the bottom of the well or from some other retaining means, such as a cement platform or a bridge plug. When the retaining means must be placed in the borehole, it is placed below the selected position of the viscous material which forms the sealing portion of the plug.

The viscous material must be placed in the borehole such that it can flow to seal the passage of fluids about the plug. Thus, in a cased well, preferably the well is prepared for placement of the viscous material by opening a port in the casing to gain access to the casing annulus. After opening a port in the casing, the viscous material can flow unimpeded into any voids behind the casing. The port should be formed at a position adjacent an impermeable rock layer. Preferably, the port are formed along a length of the casing, for example a length of at least 2 metres, to allow some margin of error in the positioning of the port at an impermeable rock layer. The port can be formed by perforating the casing. In a preferred embodiment, substantially all of a cylindrical section of the casing is removed such that the viscous material can flow to fill any voids behind the casing. In one embodiment, a cylindrical portion of the casing, the solid material in the annulus behind this portion of the casing and a portion of the exposed borehole wall are removed, such as by milling or grinding, prior to placement of the viscous material. By such an operation, a section is formed in the borehole which is substantially free of any material which may provide a conduit for the passage of fluids about the plug. A similar operation is also useful in the abandonment of an uncased borehole. In such a borehole, contamination on the surface of the borehole walls can be removed, thereby enhancing the integrity of the seal provided by the plug. Preferably, the removal of a portion of the borehole wall is carried out in a manner which substantially avoids fracturing of the rock.

Where the borehole has been prepared for placement of the viscous material by removing a portion of the casing and a retaining means is used to maintain the placement of the plug above the bottom of the borehole, the retaining means should be positioned to block any large voids through which the viscous material may pass down the borehole, past the retaining means.

Once the borehole is prepared, the viscous material is applied on top of the retaining means. An amount of viscous material is added to fill any voids in the borehole and to effect a seal against the pressure of fluids moving up the well from the productive zone. Further, an amount of viscous material is preferably used which can flow to fill voids which may arise over time. If necessary, weighting materials are added to the material to increase its density.

If desired, the liquid is then added above the viscous material. Liquid such as water may also be present in the borehole. This liquid will be displaced up the borehole by placement of the viscous material and, therefore, will be present above the viscous material and can remain there.

The present plug can be used in the abandonment of a well which passes through a plurality of productive zones. The plug can be placed such that the viscous material is able to extend through a plurality of productive zones and impermeable layers. Where the well is cased, a cylindrical section of the casing or casing and surrounding cement and borehole wall can be removed at each impermeable layer between the productive zones or the casing can be perforated at each impermeable layer.

As noted hereinbefore, the seal can also be used in the casing annulus to complete a cased well. The casing annulus seal can be used in a cased well having no cement or in a cased well having cement behind at least portions of its length. The casing annulus seal prevents the migration of fluids outside of the casing, but fluids can still pass through the casing tube.

In a cased well having no solid annular material, the seal can be placed at any location in the casing annulus. It can extend for substantially the entire length of the casing or only along a portion thereof. The viscous material is retained in the annulus of the casing in any suitable way, such as by an external packer or by introduction of an amount of cement which is allowed to set below the viscous layer. The viscous material can be introduced into the casing annulus using any suitable means, for example, a one-way check valve mounted adjacent the lower opening of the casing and a wiper plug. The wiper plug is forced down the casing after introduction of the viscous material to force the material through the check valve and into the casing annulus. An amount of un-set cement can be introduced after the viscous material such that it is positioned below the viscous material in the annulus. When set the cement will act to retain the viscous material in sealing position in the annulus.

Where the cased well contains cement or an anchor in the annulus along a portion thereof, the viscous material can be introduced into the casing annulus above and/or, if possible, below the cement. Where the bottom of the casing is open and not blocked by cement, standard completion procedures can be used, as described above, to introduce the viscous material to the casing annulus.

Where the viscous material is to be introduced above the existing cement or anchor, any suitable method can be used to position the viscous material. As an example, perforations can be made in the casing above the cement or anchor through which the material can be introduced to the casing annulus. The perforations can be patched, according to known procedures, to permit the well to be returned to production. In another method, the viscous material is poured into the annulus from above. In yet another method, the viscous material is introduced through a stage collar.

The viscous material is placed in the casing annulus to extend past at least one impermeable layer to prevent interzonal migration of fluids outside the casing. The viscous material can have added thereto weighting materials to increase its density, thereby, to increase the hydrostatic pressure of the material in the annulus. Alternately or in addition, water can be added above the viscous material to increase the hydrostatic pressure.

Once the well is completed by introduction of the viscous material into the casing annulus, the well can be placed into or returned to production. The seal prevents migration of fluids outside the casing. Where it is desired to open a new producing zone along the well, an amount of cement can be introduced into the casing annulus at the desired location of the productive zone and allowed to set at that location. Perforations are then made through the cement layer to gain access to the producing zone.

To abandon a well which has viscous material disposed in the annulus, the casing can be filled with further amounts of viscous material with or without initially perforating the casing to allow communication between the inside of the casing and the annulus.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
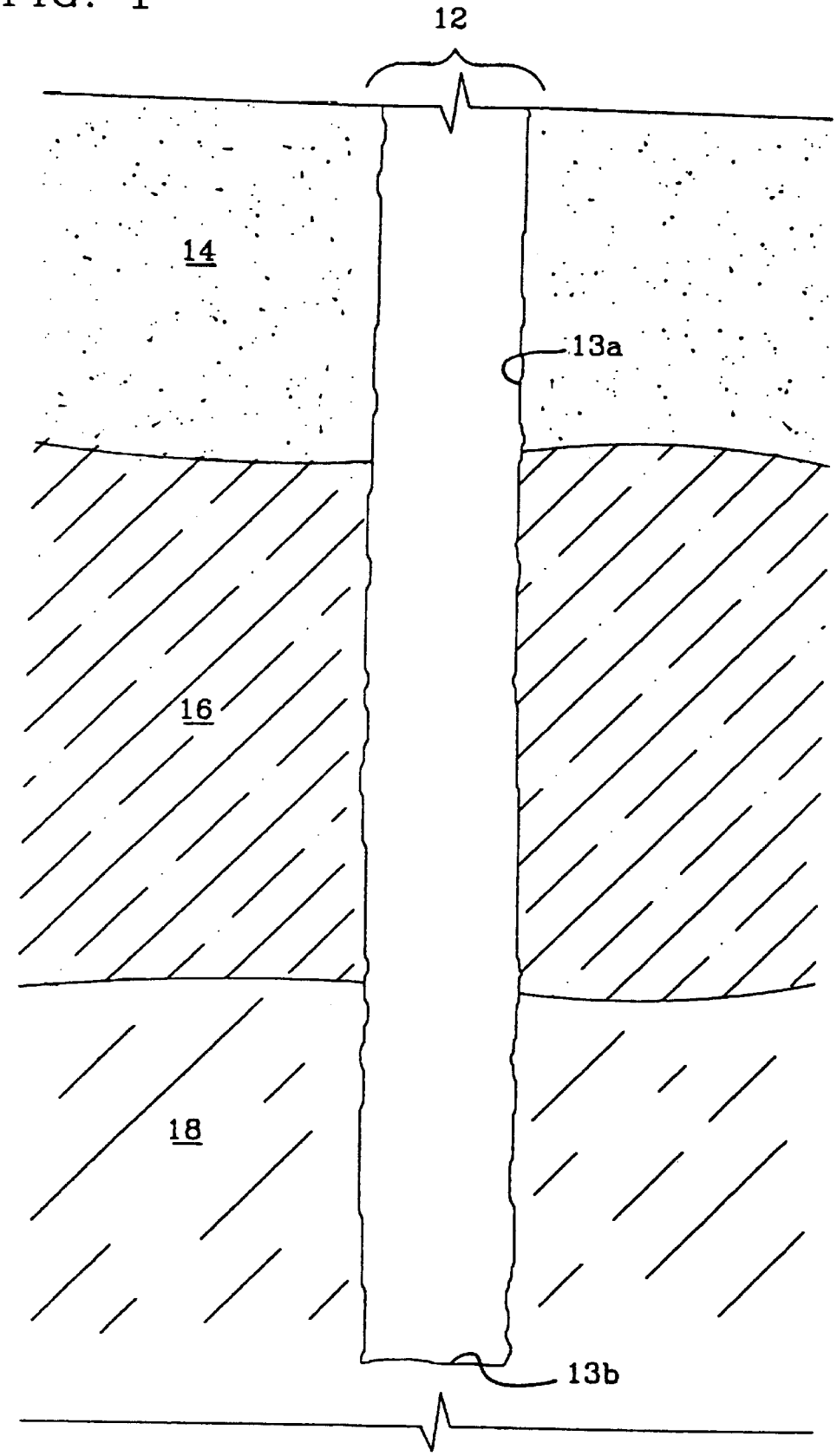
FIG. 1 shows a schematic representation of a section along an open borehole.

Referring to FIG. 1, a sectional schematic view of an open borehole is shown. The borehole, indicated at 12, is defined by walls 13*a* and bottom 13*b* and passes through a formation including an upper permeable layer 14 and an impermeable rock layer 16 into a permeable layer, termed the productive zone 18.

Figure 2:
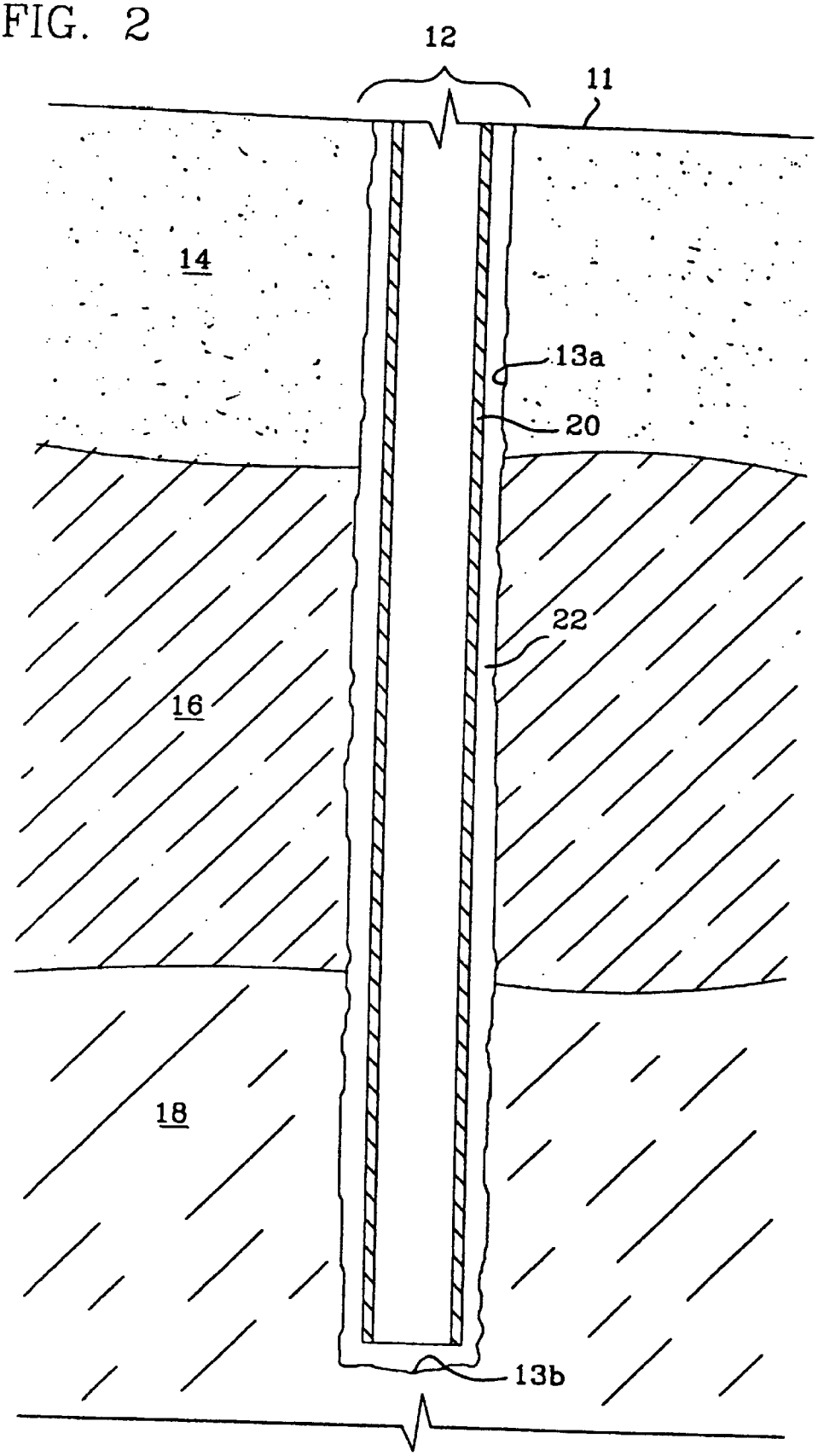
FIG. 2 shows a schematic representation of a section along a borehole, the borehole having been cased with a casing tube.

Referring to FIG. 2, a borehole 12 having a casing tube 20 therein is shown. Casing tube 20 is commonly formed of steel. The casing extends substantially from the ground surface 11 to bottom 13*b* of borehole. An annulus 22 is formed between casing 12 and borehole walls 13*a*.

Figure 3:
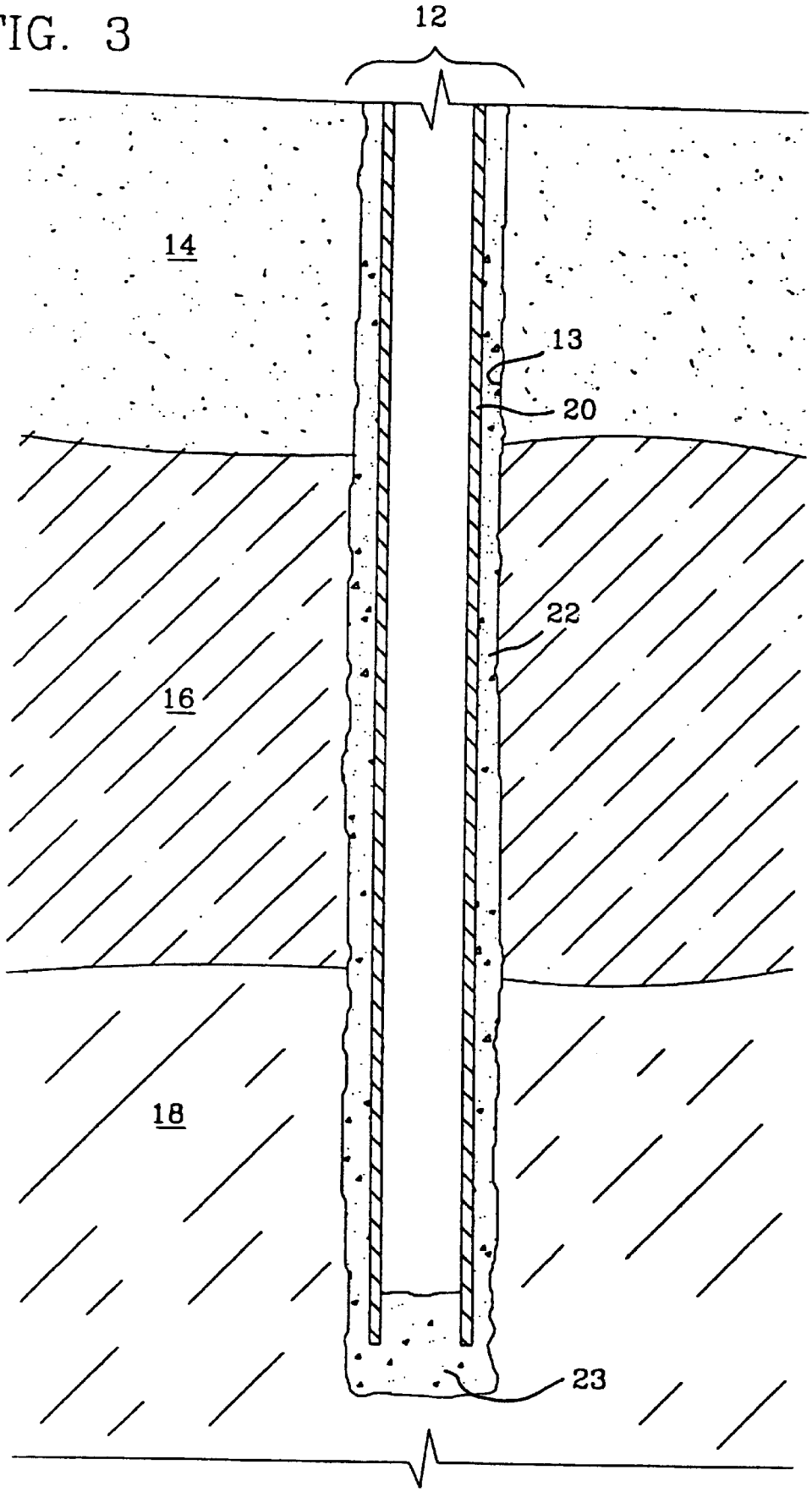
FIG. 3 shows a schematic representation of a section along a borehole, the borehole having been cased and completed, according to the prior art, by placement of cement in the annulus about the casing.

FIG. 3 shows, a sectional schematic view of a conventional cased and sheathed well is showing having a borehole, indicated at 12 and defined by walls 13*a* and bottom 13*b*, which passes through a formation including an upper permeable layer 14 and an impermeable rock layer 16 into a production zone 18. Within borehole 12 is a casing 20 formed of steel. Cement 22*a* is positioned in the annulus about casing 20. Prior to abandonment, the well is substantially uniform having the arrangement of casing and sheath along most of the borehole, as shown. Casing 20 is embedded in a cement anchor 23 at its lower end.

A well abandonment plug according to the present invention can be used in uncased or cased wells.

Figure 4:
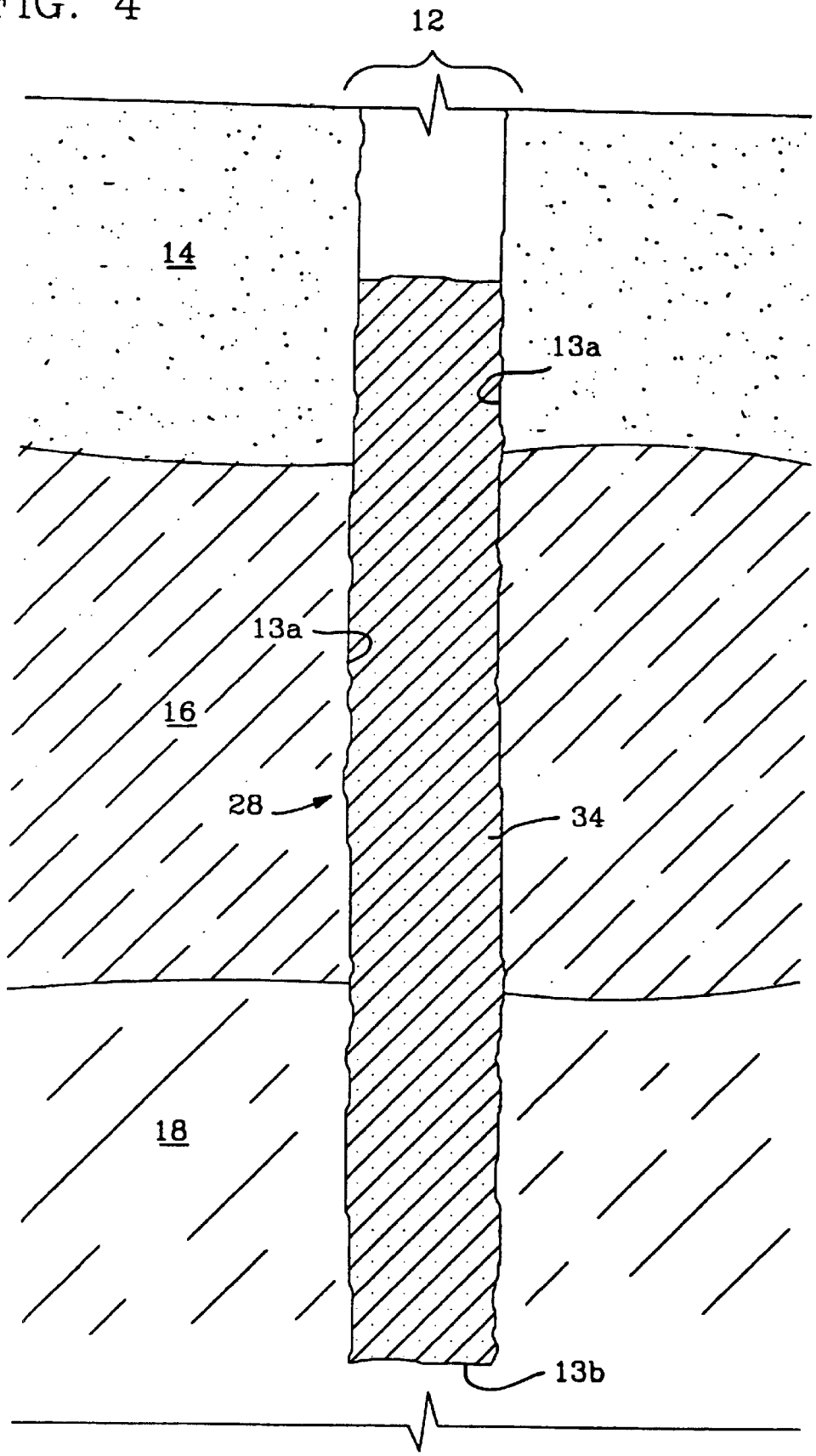
FIG. 4 shows a schematic representation of a section along a plug according to the present invention, the plug being positioned within a borehole.

Referring to FIG. 4, a sectional schematic view of a plug 28 according to the present invention is shown. Plug 28 is placed in borehole 12 of a well to prevent the passage of gas and liquid into and through the well at the position of the plug. Plug 28 includes bitumen 34 which may contain particulate matter and, preferably, fine grain particulate matter. The bitumen is positioned to extend up the borehole from its bottom 13*b* past the impermeable rock layer 16.

The hydrostatic force of the bitumen causes the bitumen to be brought into close contact with the walls 13*a* of borehole 12 and forced into cracks in the borehole wall. Because the bitumen is viscous at borehole conditions, the bitumen can flow to seal any cracks which may develop over time in the borehole.

To place plug 28, the bitumen is introduced to the borehole by any suitable means. For example, the bitumen can be heated, to reduce its viscosity temporarily, enabling it to be pumped down the well. In another embodiment, the mixture is cooled to a solid or near-solid state and processed to form solid pellets. The pellets are dumped down the well bore. Once in place, the heat within the well causes the bitumen pellets to liquefy to the viscous state to effect well bore plugging. In another embodiment, the pellets are maintained separate during the placement process by admixing the pellets with a liquid, such as water. The water is introduced with the pellets to the well bore. In yet another embodiment, the bitumen is introduced as an emulsion in water.

A column of bitumen is introduced to the well to yield sufficient hydrostatic pressure to prevent the passage of fluids from the productive zone into the wellbore. This can be done by simply adding bitumen until the passage of fluids is stopped. Alternately, the fluid pressure in the productive zone can be determined and this pressure can be used to determine the required height of bitumen which is required to effect a seal. From a knowledge of the fluid pressure of the production zone and the density of the bitumen, the required height of the bitumen column can be calculated. This height can then be translated into the required volume from a knowledge of the wellbore dimensions and volume factor. More specifically, the required height of the bitumen column can be obtained, as follows:

$$H=P\cdot(1+SF)/(S.G.\cdot 9.81)$$

Where H=requited hight of bitumen column (m)
P=fluid pressure of the production zone (kPa)
S.G.=specific gravity of bitumen
9.81=constant equal to the hydrostatic gradient of water (kPa/m)
SF=safety factor If one assumes that P=1,000 kPa, S.G.=1.01 and SF=0.25, then $$H = (1{,}000\ \text{kPa}\cdot(1+0.25)/1.01\cdot 9.81\ \text{kPa/m})$$
$$= 126.2\ \text{m}$$

To translate this height into volume of bitumen, a knowledge of the volume factor of the wellbore is required. If one assumes the borehole is 158.75 mm in diameter with no casing in the hole, the volume factor would be 0.0198 $m^3$/m. The required volume of bitumen, V, would then become:

$$V = H\cdot 0.0198\ \text{m}^3/\text{m}$$
$$= 126.2\ \text{m}\cdot 0.0198\ \text{m}^3/\text{m}$$
$$= 2.5\ \text{m}^3$$

In summary, the resultant hydrostatic pressure of the plug can be raised by increasing the height of the bitumen column or by increasing the specific gravity of the bitumen by adding weighting materials to it.

Figure 6:
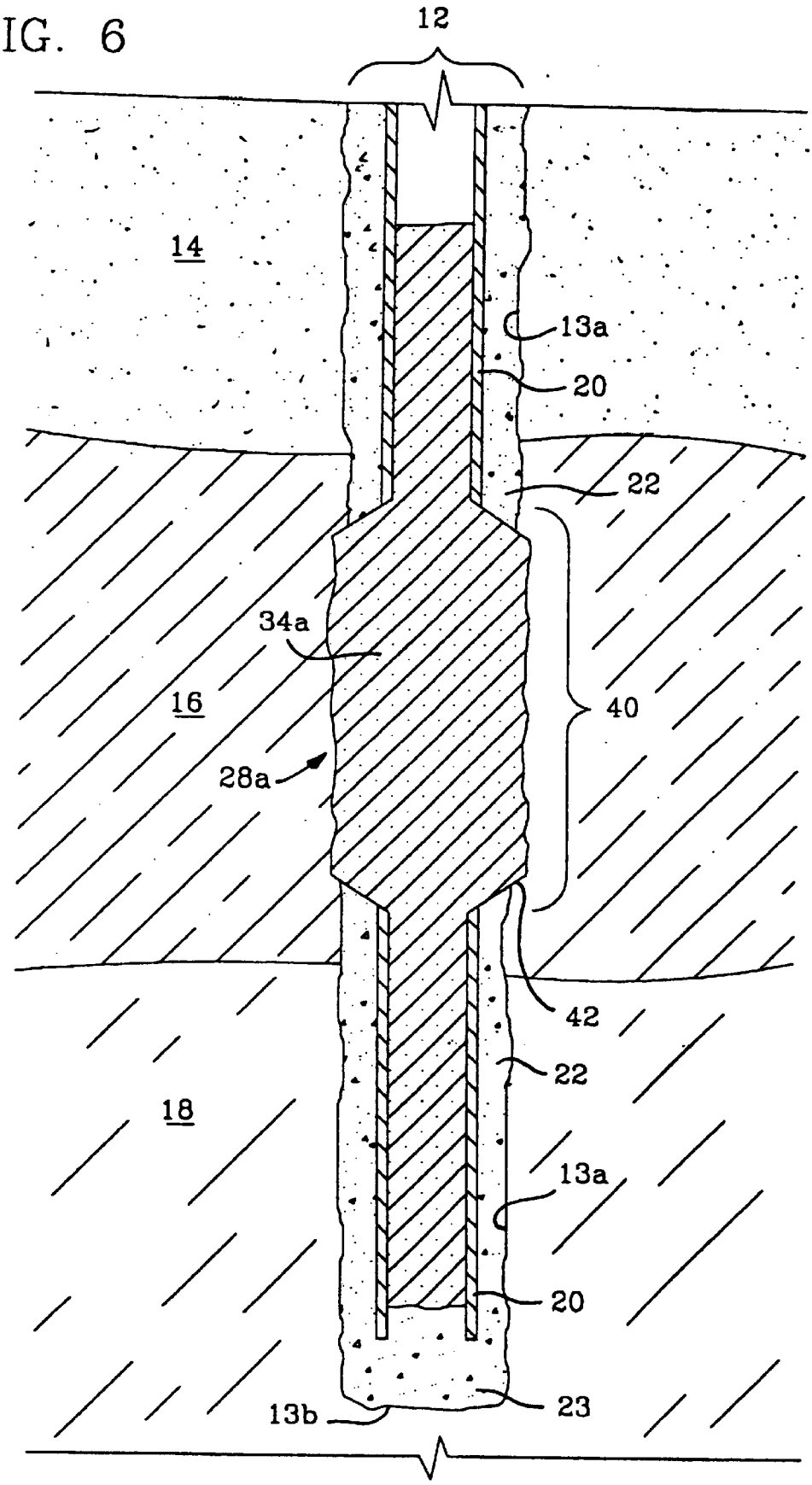
FIG. 6 shows a schematic representation of a section along another plug according to the present invention, the plug being positioned within a borehole.

Referring to FIG. 6, a sectional schematic view of a another plug 28*a* is shown. Plug 28*a* is placed in borehole 12 of a well to prevent the passage of gas and into the well borehole. Plug 28*a* includes asphalt 34*a* positioned on top of cement layer 23 which was placed in the well during the well completion. Cement layer 23 acts to retain asphalt 34*a* in its position in the well. The total hydrostatic force of the mixture causes it to be forced into close contact and into cracks in the borehole wall, the casing and any cement in the borehole by the hydrostatic force, and will continue to do so as the casing disintegrates.

Figure 5:
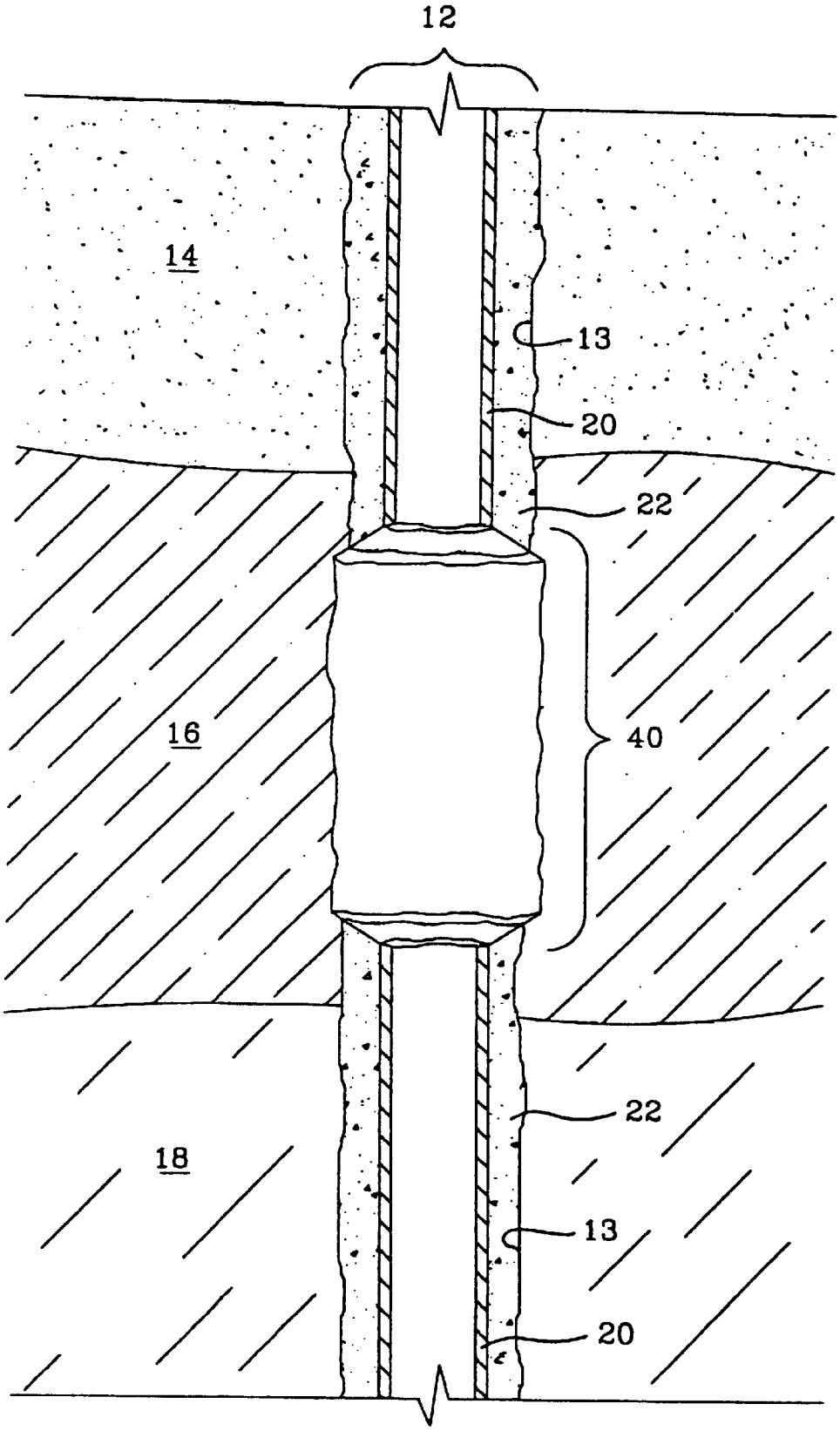
FIG. 5 shows a schematic representation of a section along a well, the well having had a section of casing, the cement in the casing annulus removed and a portion of the borehole wall removed.

The preferred process for placement of plug 28*a* can be better understood by referring to FIGS. 3, 5, and 6. After examination of well information, a position is located substantially adjacent impermeable layer 16. As best seen in FIG. 5, at this position, a section of the well is milled out to remove a cylindrical portion of the casing, the cement behind the casing and a layer of the borehole wall to form a section, indicated at 40. At least a portion of section 40 is within impermeable rock layer 16.

Mixture 34*a* is placed into the well in a sufficient volume such that a column is formed which extends from layer 23 up into section 40 and produces a sufficient hydrostatic pressure to prevent fluids from passing the plug. Mixture can be introduced to the well by first heating it, to reduce its viscosity temporarily, enabling it to be pumped down the well and onto cement layer 23. The mixture can be placed down the well by other methods. In one embodiment, the mixture is cooled to a solid or near-solid state and processed to form solid pellets. The pellets are placed on top of layer 23 by dumping them down the well bore. Once in place, the heat within the well causes the asphalt pellets to liquefy to the viscous state to effect well bore plugging. In another embodiment, the pellets are maintained separate during the placement process by admixing the pellets with a liquid, such as water. The water is introduced with the pellets to the well bore. In yet another embodiment, the asphalt is introduced as an emulsion.

Figure 7:
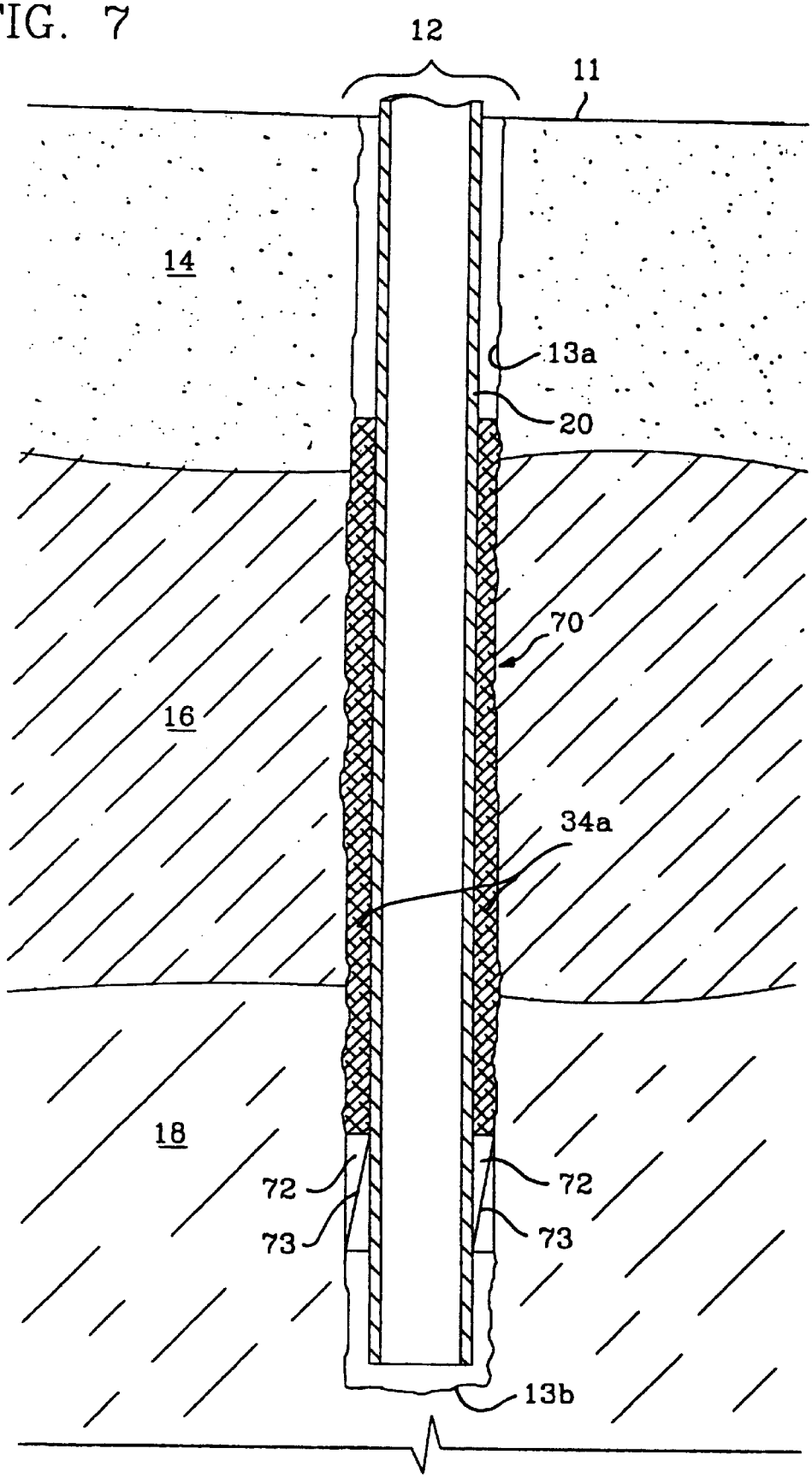
FIG. 7 shows a schematic representation of a section along a cased borehole, the borehole having a seal placed in the casing annulus according to a process of the present invention.

FIG. 7 shows a sectional schematic view of a cased well having a casing annulus seal 70 according to the present invention. Casing annulus seal 70 is used in well completion to prevent the migration of fluids outside of the casing between a productive zone 18 and another layer, for example a permeable layer 14, while permitting the passage of fluids within the casing. Seal 70 is formed of asphalt 34*a* which is retained in position in the annulus 22 of casing 20 by an external casing packer 72. Packer 72 has at least one one-way flapper valve 73 which permits liquids to flow upwardly through the valve but restricts flow in the reverse direction. At least a portion of the asphalt 34*a* is adjacent the impermeable rock layer 16. Preferably, the asphalt fills the full length of the casing annulus.

The casing annulus seal is positioned by pumping the asphalt down the inside of the casing and up around the bottom of the casing tube 20 past the packer into the annulus 22. Once in place in the annulus, the asphalt is prevented from draining back into the casing tube 20 by the packer 72 in combination with the flapper valve 73.

If necessary, depending on the pressure of fluids in the well, weighting materials are added to the asphalt to be used in the seal. The asphalt can alternately be introduced in the form of an emulsion.

There are many other methods for placing a casing annulus seal according to the present invention in position. FIGS. 5 to 7 illustrate some exemplary methods.

Figure 8:
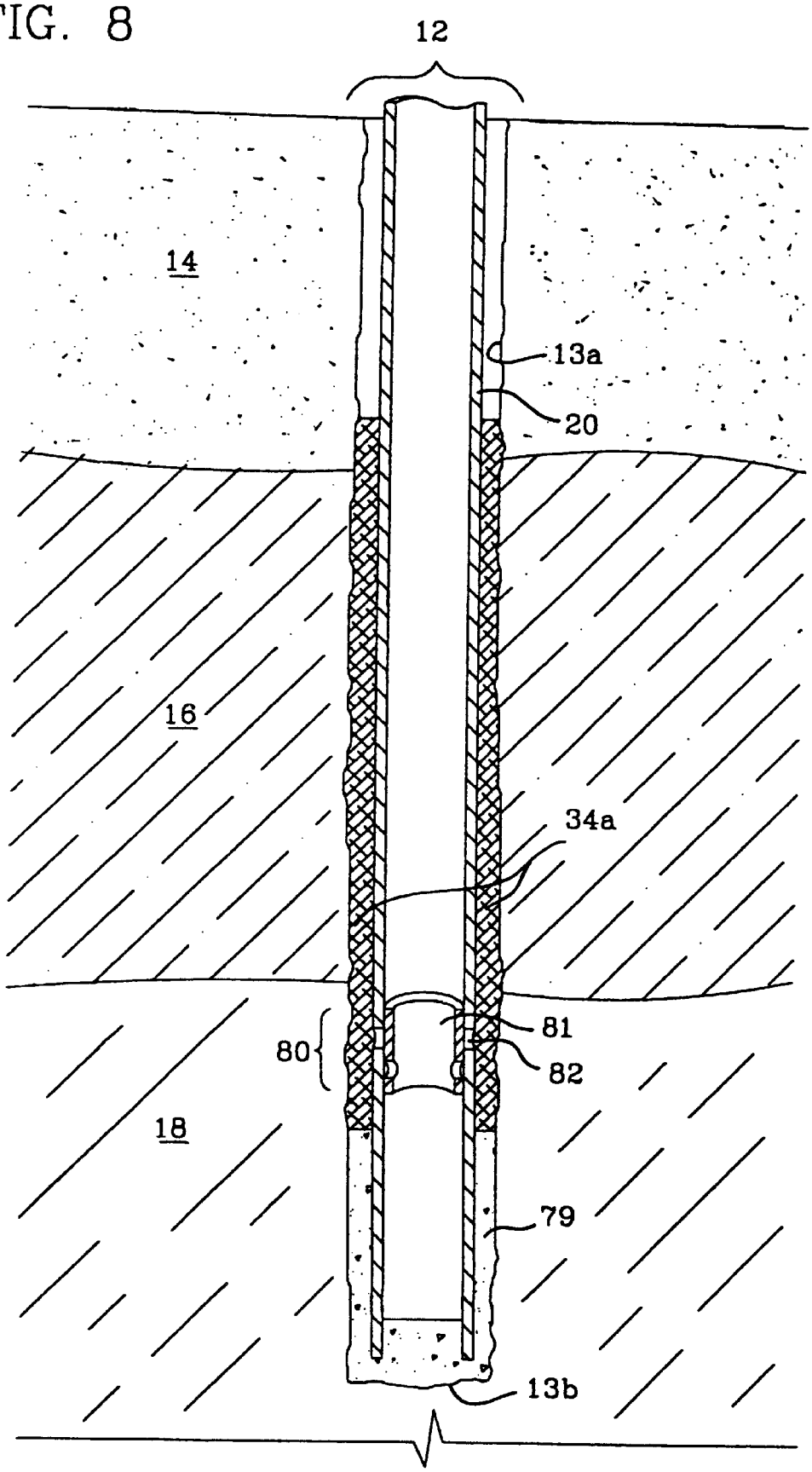
FIG. 8 shows a schematic representation of a section along another completed well according to the present invention.

Referring to FIG. 8, the seal is positioned in a borehole 12 having a casing tube 20 anchored by a cement grout anchor 79. A stage collar 80 is provided in casing 20 above anchor 79. Stage collar 80 has a sliding sleeve 81 that can be moved to a first position to open access ports 82 to annulus 22 and to a second position to seal access ports 82. The casing annulus seal is formed of asphalt 34*a* which is introduced to annulus 22 through ports 82, when the sleeve is in the first position. When a desired amount of asphalt is introduced to the annulus, the sliding sleeve 81 is moved to the second position to seal the access ports. The asphalt is retained in the annulus by the cement anchor and the sealing sleeve.

Figure 9:
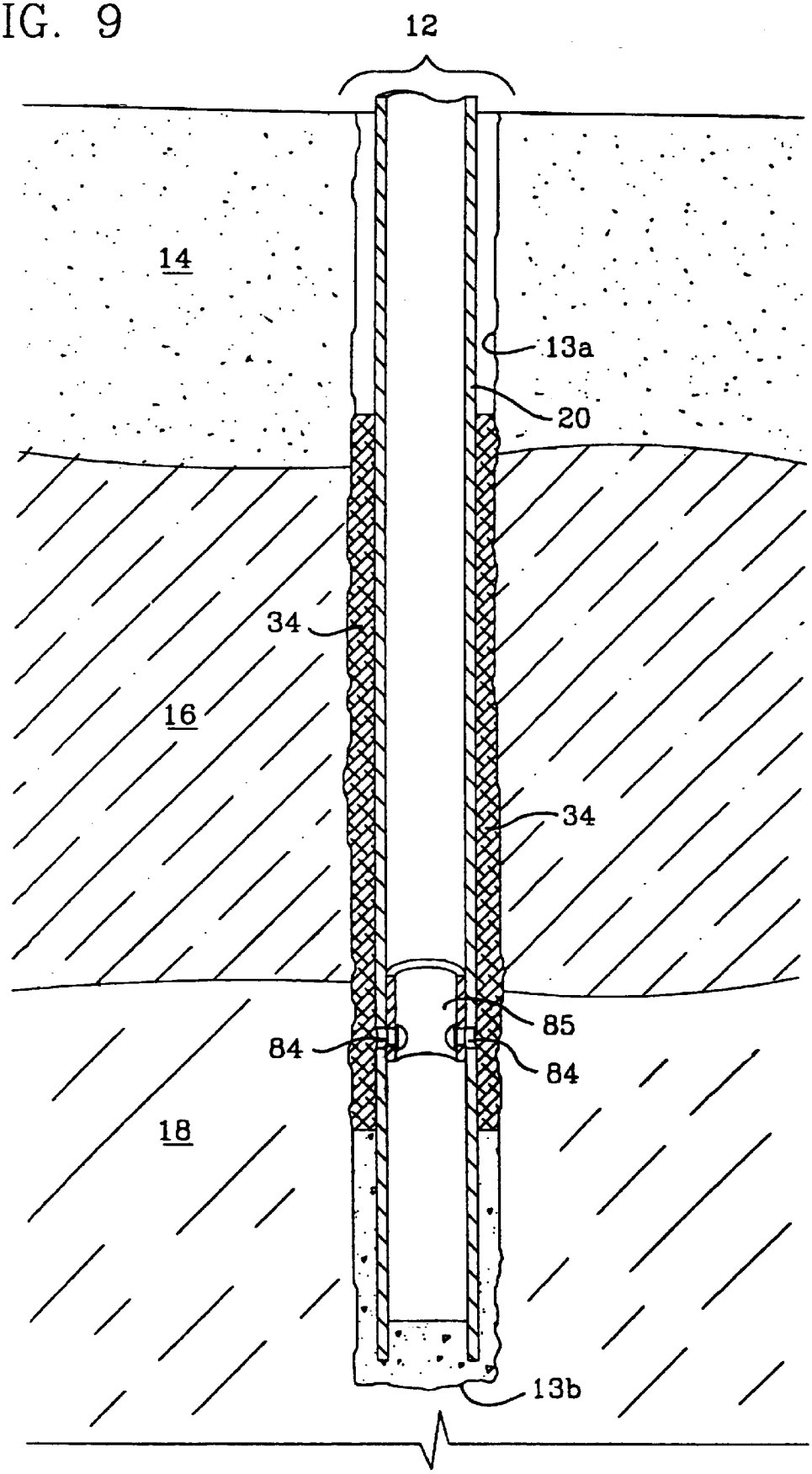
FIG. 9 shows another schematic representation of a section along another completed well according to the present invention.

FIG. 9 shows another casing annulus seal in which the bituminous material 34 of the seal is introduced into the annulus by first forming perforations 84 through casing 20 above cement anchor 79 and forcing the material 34 therethrough. After the annulus 22, is filled to a selected level with the asphalt, a metal patch 85 is then secured over perforations 84 to prevent the material from draining back into the casing.

Figure 10:
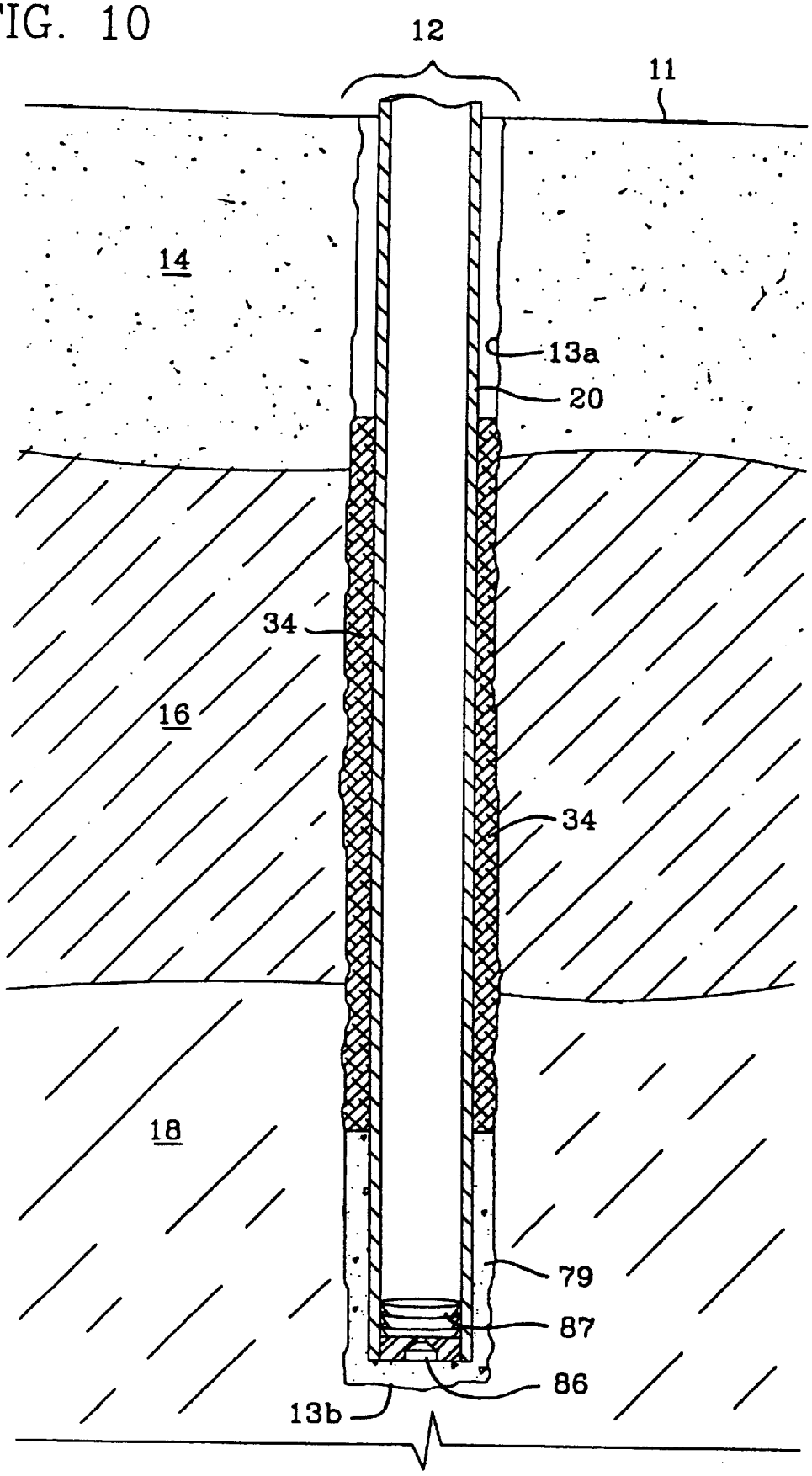
FIG. 10 shows another schematic representation of a section along another completed well according to the present invention.

FIG. 10 shows another casing annulus seal which is formed by first pumping an amount of bituminous material 34 down the casing tube 20, followed by an amount of un-set cement. The bituminous material and cement are forced through a check valve 86 into the annulus by a wiper plug 87. The cement will eventually set to form an anchor to retain the bituminous material in position in the annulus.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A process for sealing a borehole having a bottom, the process comprising:

placing an amount of a bituminous material into the borehole to extend up from the bottom of the borehole, the bituminous material being selected to remain viscous over time in borehole conditions retaining its ability to flow.

2. The process of claim 1 wherein the amount of bituminous material added is sufficient to prevent fluids from entering the borehole from a surrounding formation.

3. The process of claim 1 wherein an exposed layer of the impermeable rock layer is removed prior to placement of the bituminous material.

4. The process of claim 1 wherein the bituminous material is a mixture of fine grain particulate matter and bitumen.

5. The process of claim 1 wherein the bituminous material is asphalt.

6. The process of claim 1 wherein the bituminous material has a density greater than water.

7. A process for sealing a well, the well having a borehole defined by a bottom and side walls and being lined with a casing, the process comprising:

placing an amount of a viscous material into the casing onto the bottom of the borehole to fill a length of the borehole, the viscous material being selected to remain viscous over time in borehole conditions retaining its ability to flow.

8. The process of claim 7 wherein the amount of viscous material added is sufficient to effect a seal against the pressure of fluids moving up the borehole.

9. The process of claim 7 further comprising removing substantially all of a cylindrical section of the casing adjacent to an impermeable rock layer through which the borehole passes before placing the viscous material into the casing.

10. The process of claim 7, the well further having material disposed about the casing and the process further comprising: removing substantially all of the material exposed by removal of the casing prior to placement of the viscous material.

11. The process of claim 7 further comprising: removing a surface portion of the impermeable rock layer exposed by removal of the casing and the material disposed about the casing, prior to placement of the viscous material.

12. The process of claim 7 wherein the bottom of the borehole is covered by a material on which the viscous material is placed.

13. The process of claim 7 wherein the viscous material has a density greater than water.

14. The process of claim 7 wherein the viscous material is a bituminous material.

15. A process for completing a cased well, the well having a casing extending therein and a casing annulus surrounding the casing, the process comprising:

retaining an amount of a viscous material in the casing annulus, the viscous material being selected to remain viscous over time in borehole conditions, to retain its ability to flow.

16. The process of claim 15 wherein the amount of viscous material added is sufficient to effect a seal against the pressure of fluids moving through the casing annulus.

17. The process of claim 15 wherein the viscous material is retained in the casing annulus by a mechanical device.

18. The process of claim 15 wherein the viscous material is retained in the casing annulus by a cement layer adjacent the lower end of the casing annulus.

19. The process of claim 18 wherein the cement layer is introduced after the viscous material.

20. The process of claim 18 wherein the cement layer is introduced before the viscous material.

21. The process of claim 15 wherein the viscous material is a bituminous material.

22. The process of claim 15 wherein the viscous material has a density greater than water.

23. A process for completing a cased well, the well having a casing extending therein and a casing annulus surrounding the casing, the process comprising:

retaining an amount of a bituminous material in the casing annulus, the bituminous material being selected to remain viscous over time in borehole conditions, to retain its ability to flow.

24. The process of claim 23 wherein the amount of bituminous material added is sufficient to effect a seal against the pressure of fluids attempting to move through the casing annulus.

25. The process of claim 23 wherein the bituminous material is retained in the casing annulus by a mechanical device.

26. The process of claim 23 wherein the bituminous material is retained in the casing annulus by a cement layer positioned to plug a portion of the casing annulus.

27. The process of claim 26 wherein the cement layer is introduced after the bituminous material.

28. The process of claim 26 wherein the cement layer is introduced before the bituminous material.

29. The process of claim 23 wherein the bituminous material is asphalt.

30. The process of claim 23 wherein the bituminous material is fine grain particulate matter in bitumen.

31. The process of claim 23 wherein the bituminous material has a density greater than water.

32. A casing annulus seal comprising:

an amount of viscous material disposed in the casing annulus, the material being selected to remain viscous over time in borehole conditions, and a means for retaining the viscous material in the annulus.

33. The seal of claim 32 wherein the means for retaining is a mechanical device.

34. The seal of claim 32 wherein the means for retaining is a cement layer positioned to plug a portion of the casing annulus.

35. The seal of claim 32 wherein the viscous material is a bituminous material.

36. The seal of claim 32 wherein the viscous material has a density greater than water.

37. The process of claim 32 wherein the amount of viscous material in the annulus forms a vertical column sufficient to effect a seal against the pressure of fluids attempting to migrate into the annulus.

38. A casing annulus seal comprising:

an amount of bituminous material disposed in the casing annulus, the bituminous material being selected to remain viscous over time in borehole conditions, to retain its ability to flow and the amount of material in the annulus being sufficient to effect a seal against the pressure of fluids attempting to migrate thought the annulus; and a means for retaining the bituminous material in the annulus.

39. The seal of claim 38 wherein the means for retaining is a mechanical device.

40. The seal of claim 38 wherein the means for retaining is a cement layer positioned to plug a portion of the casing annulus.

41. The seal of claim 38 wherein the bituminous material is asphalt.

42. The seal of claim 38 wherein the bituminous material is fine grain particulate matter in bitumen.

43. The seal of claim 38 wherein the bituminous material has a density greater than water.

44. A well comprising:

a borehole having a wall and lined along a portion of its length with a casing;

an amount of viscous material disposed in the casing annulus, the material being selected to remain viscous over time in borehole conditions; and a means for retaining the viscous material in the annulus.

45. The well of claim 44 wherein the amount of viscous material is sufficient to effect a seal against the pressure of fluids attempting to move through the casing annulus.

46. The well of claim 45 wherein the means for retaining is a mechanical device.

47. The well of claim 45 wherein the means for retaining is a cement layer positioned to plug a portion of the casing annulus.

48. The well of claim 45 wherein the viscous material is a bituminous material.

49. The well of claim 45 wherein the viscous material has a density greater than water.

* * * * *